US005697778A

United States Patent [19]

Hemsath

[11] Patent Number: 5,697,778

[45] Date of Patent: Dec. 16, 1997

[54] DAISYWHEEL CONVECTOR PLATE FOR BATCH COIL ANNEALING FURNACE

[75] Inventor: Klaus H. Hemsath, Toledo, Ohio

[73] Assignee: Indugas, Inc., Toledo, Ohio

[21] Appl. No.: 382,297

[22] Filed: Feb. 1, 1995

[51] Int. Cl.[6] ..... C21D 9/00

[52] U.S. Cl. ..... 432/260; 432/205

[58] Field of Search ..... 432/4, 5, 9, 23, 432/77, 239, 242, 247, 249, 253, 260

[56] References Cited

U.S. PATENT DOCUMENTS

| | | |
|---|---|---|
| 3,140,743 | 7/1964 | Cone . |
| 4,275,569 | 6/1981 | Mayers et al. . |
| 4,310,302 | 1/1982 | Thekdi et al. . |
| 4,502,671 | 3/1985 | Omura . |
| 4,846,675 | 7/1989 | Soliman . |
| 5,295,822 | 3/1994 | Hemsath . |

*Primary Examiner*—Henry Bennett
*Assistant Examiner*—Gregory Wilson
*Attorney, Agent, or Firm*—Frank J. Nawalanic

[57] ABSTRACT

An improved convector plate is provided for a batch coil annealing furnace. The plate includes a top annular plate, an identical bottom annular plate and an annular diverter plate in between. A plurality of slotted openings are provided in the top and bottom plates which extend radially outwardly from a first imaginary circle spaced from the inner peripheral edge of the top and bottom plates to an imaginary second circle spaced inwardly from the top and bottom plate's outer peripheral edge. The annular diverter plate is radially centered within the slotted openings. When the convector plate is placed between the edges of two coils, furnace atmosphere flows into the convector plate in the space between the top and bottom plates and is directed by the diverter plate into the slotted openings which are now covered by the coil edges thus establishing improved convective heat transfer rates with the coil edges resulting in shorter annealing process times.

29 Claims, 3 Drawing Sheets

DAISYWHEEL CONVECTOR PLATE FOR BATCH COIL ANNEALING FURNACE

This invention relates generally to batch coil annealing furnaces and more particularly to an improved convector plate for use in a batch coil annealing furnace.

While the invention has been specifically developed for use in a batch coil annealing furnace and will be described with particular reference thereto, those skilled in the art will understand that the invention is not limited to the annealing process, per se, but rather can be applied to any batch process for heating/cooling of work where the work is stacked one on top the other and a convective heat transfer between the work edges and furnace atmosphere is desired.

INCORPORATION BY REFERENCE

My U.S. Pat. No. 5,295,822, dated Mar. 22, 1994, and U.S. Pat. No. 4,310,302 to Thekdi et. al., dated Jan. 12, 1982, are incorporated by reference herein so that details known in the art relating to batch coil annealing furnaces and heat transfer problems need not be restated herein. The incorporated patents do not form part of the present invention.

BACKGROUND

In one widely practiced, industrial metal treating process, metal strip formed in a rolling mill is tightly wound into coils and several coils, stacked one on top the other, are annealed or heat treated as a batch in a batch coil annealing furnace. While this is an acknowledged old process, improvements in strip metallurgy and process times achieved by strip lines have resulted in numerous improvements made to batch coil annealing furnaces to achieve comparable results. For example, better metallurgical results in batch furnaces have been achieved by utilizing hydrogen or hydrogen based atmospheres. Processing time has been reduced by fan arrangements in the furnace base which use high volume flows of atmosphere about the work to significantly reduce the processing time, principally in cooling the work. The limiting factor in improving heat transfer in the batch coil annealing furnace process has been demonstrated to occur at the edge of the strip or the face of the coil. Heat is imparted throughout the body of the coil from the outside of the coil. Variations in heat transfer occur through conduction in the axial and radial directions and are significantly lower radially than the conductivity of the metal. This in turn affects metallurgy of the coil and processing times.

When the coils are stacked in the annealing furnace, they are separated from one another by a convector plate. The plates allow some of the furnace atmosphere to pass between the coils thus effecting heat transfer between the coil edges and the atmosphere. There are a wide variety of designs of convector plates. In widespread use today are a "wedge" design and, for thin gage strip, a "sandwich" design. A view of the "wedge" is shown in the drawings and both the "wedge" and "sandwich" are discussed in further detail below. In summary, though, neither design is an optimum heat transfer device. Also, and importantly, both designs are subject to thermal fatigue and, in practice, warp and crack after some limited number of cycles.

The design disclosed in my U.S. Pat. No. 5,295,822 is a significant improvement over the prior art in terms of heat transfer efficiencies. That design utilizes cascaded jet streams to impinge the steel edges which, fundamentally, is the most efficient design one can select to achieve high convective heat transfer rates with the work. However, jet streams produce "eddy" current flow effects which, for existing batch coil annealing furnaces, can create a back pressure that could affect the ingress of atmosphere into the divertor plate. Thus the efficiencies of the device, when applied to conventional batch coil annealing furnaces, could be somewhat less than what otherwise would be possible. More significantly, this design requires more space and cannot be used readily to replace existing designs due to space limitations.

Thus there still exists a need for a durable convector plate for use in conventional batch type furnaces, which can effect high rates of convective heat transfer with the coil edges, protect the edges of the coil and provide extended service life.

SUMMARY OF THE INVENTION

Accordingly, it is a principal object of the invention to provide a convector plate for use in batch type annealing furnaces and the like which can achieve high convective heat transfer rates with the edges of the coil resting on the convector plate.

This object along with other features of the invention is achieved in a batch coil annealing furnace convector plate which includes a) a top annular plate and a bottom, similarly shaped annular plate, with each plate having slotted openings formed therein extending radially outwardly from an imaginary circle and b) an annular diverter plate in between the top and bottom plates having a radial length less than the length of the openings and an inside diameter greater than that of said imaginary circle whereby the furnace atmosphere directed into the space between the top and bottom plates is split into top and bottom streams directed into good heat transfer contact with the coil edge as the furnace atmosphere travels in the slotted opening spaces or channels formed between coil edge and diverter plate while passing from the outside of the coils to the inside.

In accordance with another important aspect of the invention, the slotted openings in the top and bottom plates extend from a first imaginary circle having a diameter smaller than the inside diameter of the diverter plate to a second imaginary circle having a diameter greater than the outside diameter of the diverter plate but less than the outside diameter of the top and bottom plates so that heat transfer is effected with the middle third of the coil edge or face. Each opening is further defined by two side edges extending radially to the center of the top and bottom plates and spaced from one another at a fixed arcuate distance. Importantly the distance is sized so that area of the slotted opening or channel is reduced while the top and bottom gas streams travel towards the inside of the coil thus reducing or at least maintaining the heat transfer boundary area at the coil edge constant along the length of the opening.

In accordance with another aspect of the invention, each top and bottom plate has a slit extending therethrough from the outer periphery of each plate to at least one of the openings in the plate. Significantly, the diverter plate is held loosely in position between the top and bottom plates by inner and outer radially extending supports extending between and welded to the top and bottom plates whereby the convector plate is able to thermally distort without experiencing thermal failures attributed to thermal expansion/contraction or thermal fatigue.

In accordance with yet another aspect of the invention, an improvement is provided to a batch coil annealing furnace having a base upon which a plurality of stip coils are stacked one on top the other. A cylindrical, closed end or bell shaped cover is releasably sealed to the base and encloses the coils while a burner arrangement associated with the cover heats the cover to, in turn, heat the furnace atmosphere within the cover. A fan in the base circulates furnace atmosphere within the cover under pressure from the outside of the coils to the inside thereof by flowing the furnace atmosphere i) over the top of the coil stack and ii) between the edges of adjacent coils separated from one another by a convector plate. The improvement includes the convector plate described above which enhances the heat transfer efficiency of the batch coil annealing furnace.

In accordance with yet another aspect of the invention, a process is provided for convectively heating and cooling metal strip wound into coils and placed in a batch coil annealing furnace so that the coils are vertically stacked on a base one on top of the other while separated from each other by a convector plate therebetween and a fan causes hot or cooled furnace atmosphere to circulate within a bell shaped cover in a continuous loop from the base, around the outside of the coils to the top coil and into the coil centers downward to the base while a portion of the atmosphere travels radially between the coils through the convector plates. The process includes the steps of: a) providing a solid annular diverter plate between two larger top and bottom annular plates, each larger plate having radially slotted openings overlying the diverter plate; b) directing a portion of the furnace atmosphere into the space between the top and bottom plates at the peripheral edge thereof as a gas stream; c) splitting the stream at the outer peripheral edge of the diverter plate into a top stream and a bottom stream; d) directing the top and bottom steams into heat transfer contact with the coil edge overlying the slotted openings while the streams travel radially inwardly in the slotted opening channel between the convector plate and the coil's edge; and e) combining the top and bottom streams at the inner peripheral edge of the diverter plate in the space between the top and bottom plates before exhausting same to the center of the coil. Significantly, the process effects a high convective heat transfer with the strip tending to approach that of jet impingement, but avoids the back pressure resulting from high velocity jets which could otherwise affect free entry of fresh atmosphere into the convector plate.

It is yet another object of the invention to provide an improved convector plate which is able to withstand thermal stresses and expansion/contraction resulting therefrom to produce a durable plate.

In conjunction with the foregoing object, it is another object of the invention to provide a convector plate which is yieldable and flexible under thermal stress to improve the thermal and fatigue life thereof.

It is still another object of the invention to provide a convector plate suitable as an improved replacement for conventional, convector plates without any modifications or alterations to the existing batch coil annealing furnaces.

A still further object of the invention is to provide an improved convector plate for use in batch coil annealing processes which enhances the metallurgical process of the furnace while contributing to the overall reduction of process cycle time.

A still further object of the invention is to provide a convector plate for a batch coil annealing furnace which is economical to produce and cost competitive with existing designs while capable of improved heat transfer performance and longer durability.

These and other objects of the present invention will become apparent to those skilled in the art upon reading and understanding the detailed description of the preferred embodiment of the invention described below taken in conjunction with the drawings described in the next section.

DETAILED DESCRIPTION OF THE DRAWINGS

The invention may take physical form in certain parts and arrangement of parts, a preferred embodiment of which will be described in detail herein and illustrated in the accompanying drawings which form a part thereof and wherein.

DETAILED DESCRIPTION OF THE PREFERRED EMBODIMENT

Figure 2:
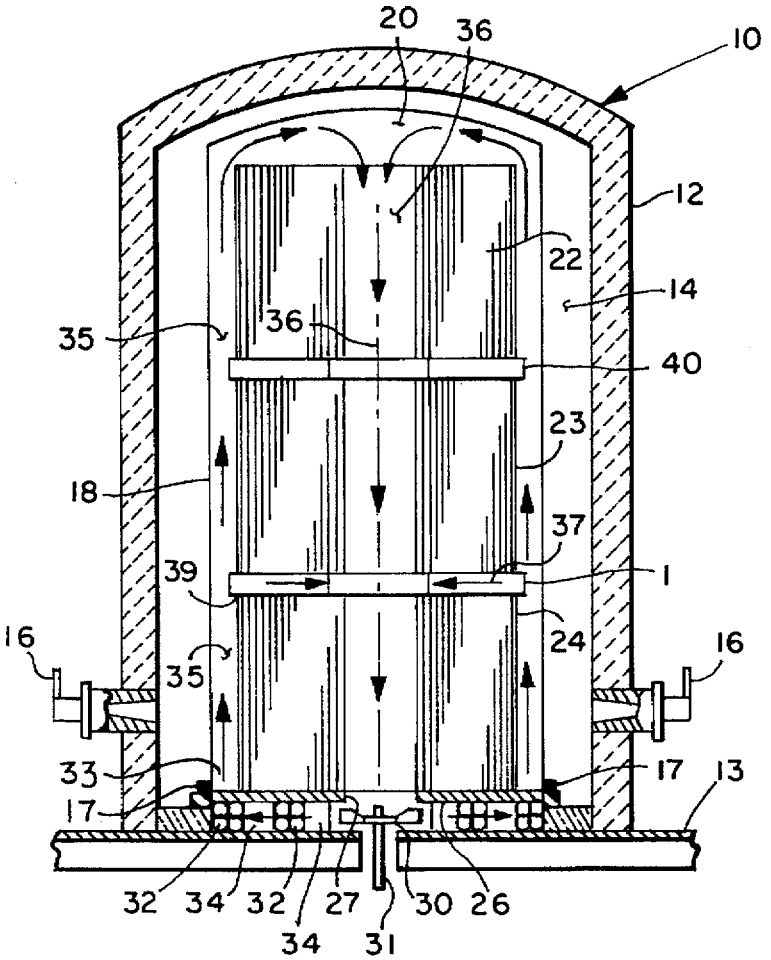
Fig. 2 PRIOR ART
FIG. 2 is a schematic, longitudinally-sectioned view of a batch coil anneal furnace.

Referring now to the drawings wherein the showings are for the purpose of illustrating a preferred embodiment of the invention only and not for the purpose of limiting same, there is shown in FIG. 2 a conventional bell shaped, batch coil annealing furnace 10. Annealing furnace 10 includes closed end cylindrical outer cover 12 sealingly secured in a releasable manner to a refractory base 13 to define a heating chamber 14 therein. Gas fired burners 16 typically mounted in outer cover 12 provide heat to heating chamber 14. Also sealed to base 13 as by diagrammatically shown seals 17 is a closed end, cylindrical inner cover 18. As well known, heat from burners 16 cause heating chamber 14 to heat inner cover 18 which in turn radiates heat to its interior, defined herein as a furnace chamber 20. Within furnace chamber 20 is a plurality of metal coils (i.e., metal strip from a rolling mill tightly wound into coils of standardized sizes). In the preferred embodiment and for convenience only, there is shown a top coil 22, a middle coil 23 and a bottom coil 24. Bottom coil 24 typically rests on a charge plate 26 which in turn rests on refractory base 13. Charge plate 26 typically has a central opening 27 concentric with the openings in coils 22–24 and in which is positioned a fan 30 driven by a motor shaft 31. Within charge plate 26 heat transfer devices 32 are typically positioned, which in conjunction with baffles 34, direct furnace atmosphere radially outwardly from the center of charge plate 26 to the outside of coils 22–24.

When coils 22–24 are heated to their annealing temperature, a gas, i.e. furnace atmosphere, is admitted to furnace chamber 20. As noted above, hydrogen and hydrogen based gas compositions have been recently used, although traditionally, inert gases have been employed as the furnace atmosphere. Rotation of fan 30 generally causes the furnace atmosphere to cycle about furnace chamber 20 in a flow path shown by arrows in FIG. 2. Typically furnace atmosphere is pumped into furnace chamber 20 at the outer periphery of charge plate 26 and enters furnace chamber 20 in an annular space 33 between the outside of bottom coil 24 and inner cover 18. The furnace atmosphere then travels upwardly in annular space 35, reaches the top portion of inner cover 20 and travels back to fan 30 through center 36 of coils 22, 23 and 24. The furnace atmosphere is heated from contact with the hot inner cover and uses its heat to, in turn, convectively heat coils 22, 23 and 24. Because the annealing cycles for carbon steel are low temperature cycles, convective heat transfer is an effective and efficient mode for transferring heat. After the coils are heated to their annealing temperature, cooling is sometimes assisted by supplying a coolant to heat transfer devices 32 and circulation of furnace atmosphere now cools coils 22–24. In most applications there are no heat transfer devices 32. In these applications, outer cover 12 is removed and water poured on inner cover 18 while fan 30 rotates. In other applications natural air cooling or fan assisted air cooling is used.

As noted above, heating and cooling of the edges of coils 22–24 is the limiting factor in the batch coil annealing process from both a processing time and metallurgical quality viewpoint. Once heat is transferred by convection or radiation to the outside of coils, it only slowly flows conductively in a radial direction into the coils. Thermal conductivity in the axial direction, to the contrary, is much larger than in the radial direction. Heat must, therefore, be preferentially transferred to the middle third of the coil, which is a specific feature of the present invention.

The prior art has provided convective heat transfer by inserting prior art convector plates 1 in between adjacent coils 22–23, 23–24. Also, a prior art convector plate 1 is inserted between bottom coil 24 and base 13 or charge plate 26 (or charge plate 26 is modified to also function as a convector plate for bottom coil 24). The top edge of top coil 22 is exposed to the flow path of furnace atmosphere and because of the added thermal heat transfer in the radial direction does not need any special provisions for transferring heat.

Figure 1:
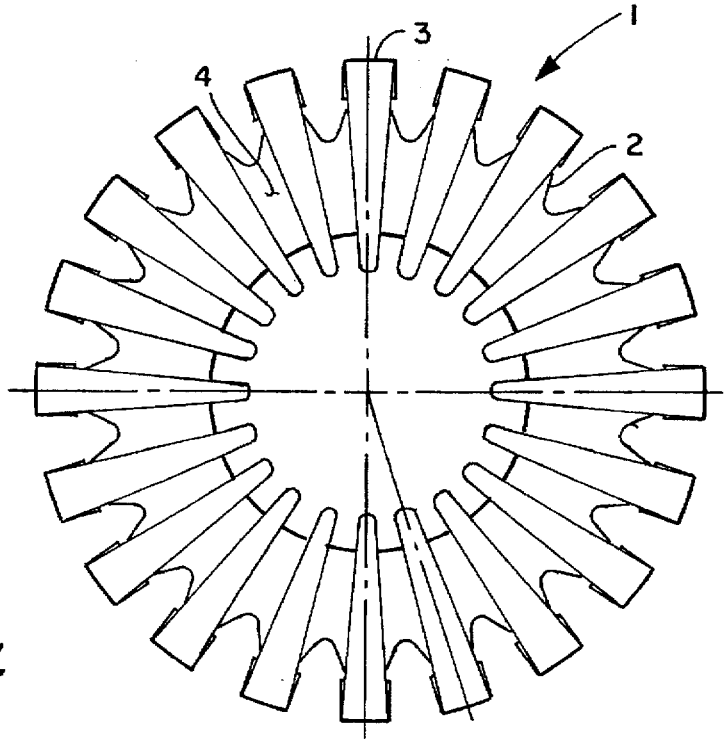
Fig. 1 PRIOR ART
FIG. 1 is a plan view of a prior art convector plate.

A plan view of a prior art wedge convector plate 1, widely used in the industry, is shown in FIG. 1. Wedge plate 1 has an annular base plate 2 and on the top and bottom surfaces thereof, wedges 3 are welded as shown. The coil face or edges contact wedges 2 and radial spaces or channels 4 between adjacent wedges are thus formed in convector plate 1. The outside diameter of the coil is slightly smaller than the outside diameter of wedge plate 1 (as shown in FIG. 2) to create an annular space (shown as 39 in FIG. 2) which serves to divert a portion of the furnace atmosphere flow (shown as arrows 37 in FIG. 2) through the convector plate, although radial flow through the coil is principally achieved by the pressure differential between the outside and inside of the coils caused by rotation of fan 30. In prior art wedge convector plate 1, the flow is through radial spaces 4 into the center of coils 22–24. There is also a "sandwich" convector plate (not shown) which is also widely used in the industry. In the sandwich convector plate, annular top and bottom plates are welded to a number of radially extending, solid bars sandwiched between the top and bottom plates to create a number of radially extending channels. The furnace atmosphere flows through the slots or channels in the top and bottom plates into the coil centers. While the prior art convector plates represent an improvement over flat plates in that furnace atmosphere is circulated between the coil edges, their convective heat transfer efficiency is limited. More specifically the heat transfer boundary layer begins at the coil edges and is already too thick to create "good" heat transfer efficiencies at the center portion (i.e., the critical center third portion) of the coil face. Still more specifically, and as somewhat noted above, the fundamental batch coil furnace arrangement is such that high flow rates can be achieved by fan 30 but at pressures not conducive to forming jets. Thus the flow is not optimally designed to achieve highest heat transfer at the middle portion of the coil face where achieving the high heat transfer efficiencies of the present invention creates the most benefits.

Apart from the heat transfer aspects, convector plates are subjected to thermal distortion and this distortion occurs in a random three dimensional warpage pattern. In wedge convector 1, wedges 3 do not thermally distort in the same manner as base plate 2 and causes base plate 2 to crack as it dishes. To alleviate this, the outer peripheral edge of base plate 2 is scalloped to permit base plate 2 to flex which is helpful but does not stop the failures. Similarly, in the sandwich prior art convector plates, the slotted top and bottom plates thermally distort and likewise crack.

Figure 3:
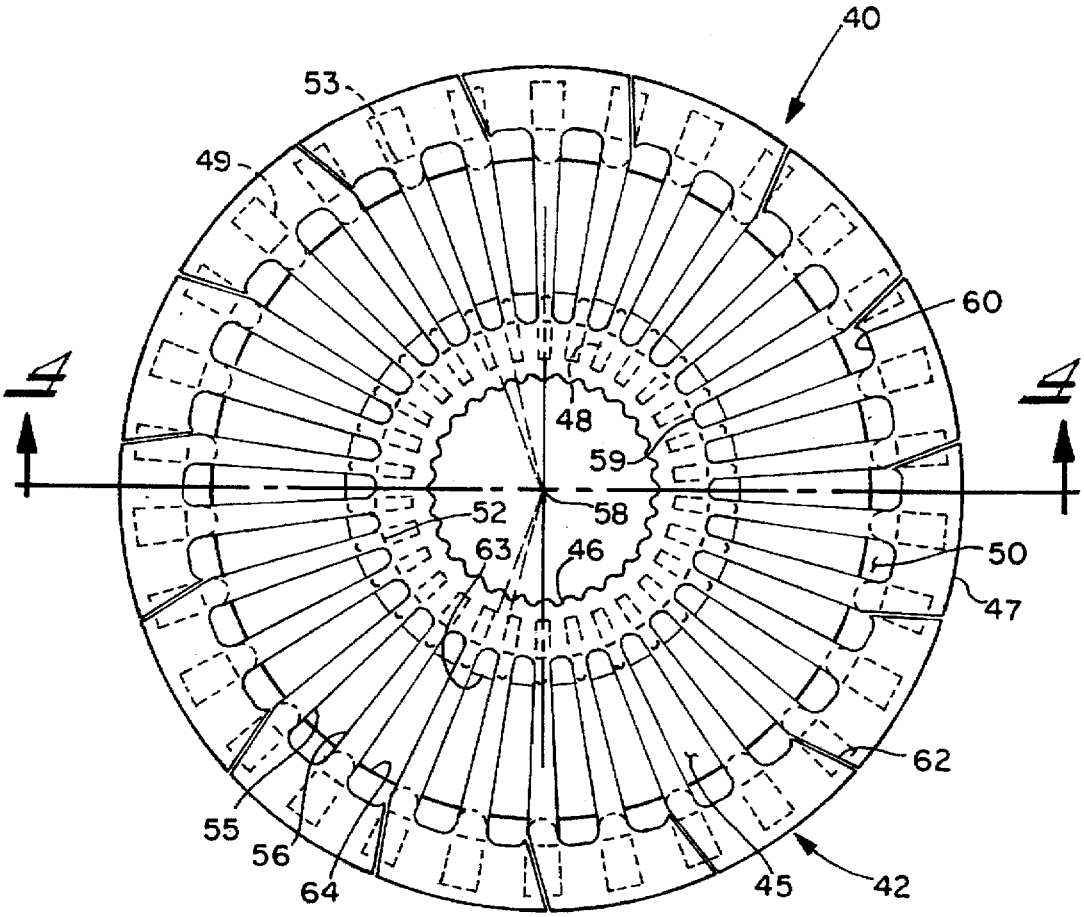
FIG. 3 is a plan view of the convector plate of the present invention.
Figure 4:
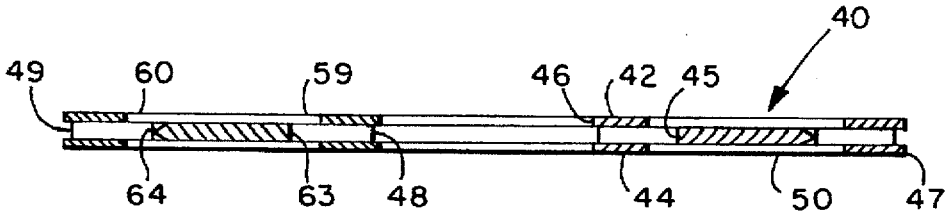
FIG. 4 is a cross-sectioned view of the convector plate of the present invention taken along lines 4—4 of FIG. 3.

Convector plate 40 of the present invention is shown in FIGS. 3 and 4 and includes an annular top plate 42, an identical annular bottom plate 44 and an annular diverter plate 45 disposed in between. Because top and bottom plates are identical, a description of top plate 42 will likewise apply to bottom plate 44 and the same reference numerals will be used with respect to both plates. Top plate 42 has an inside diameter or inner peripheral edge 46 which is shown as scalloped in configuration so as to better distort under thermal stress.

Top plate 42 has an outside diameter 47 or outer peripheral edge. Formed within top plate 42 is a plurality of slotted openings 50. Each slotted opening 50 extends from an imaginary inner circle 52 radially outwardly to an imaginary outer circle 53. In accordance with the broad features of the invention, slotted opening 50 could be in the form of any polygon. But in accordance with a more specific and important feature of the invention, each slotted opening is defined by a pair of radially extending side edges 55, 56. Side edges 55, 56, if extended, would intersect with center 58 of top plate 42 (which is co-incident with center 38 of coils 22–24). Each slotted opening 50 also has an arcuate bottom edge 59 which is generally coincident with imaginary inner circle 52 and a top arcuate edge 60 which is generally co-incident with imaginary outer circle 53. Thus it is significant to note that the area of each slotted opening 50 increases as slotted opening 50 extends radially outwardly. In order to permit flexing of top plate 42, a slit 62 is provided in top plate 42 which extends from top plate's outer peripheral edge 47 to top edge 60 of certain slotted opening 50. In the preferred embodiment shown, slit 62 extends to every other slotted opening 50 which has been found to be sufficient to allow thermal distortion of top and bottom plates 42, 44 without thermal failure.

The dimensioning of slotted opening 50, as well as diverter plate 45 is somewhat critical to the efficient operation of convector plate 40. The length of slotted opening 50 i.e., the length of side edges 55, 56, is ½ to ⅔ the radial length of top plate 42, i.e., the radial distance from inside diameter 46 to outside diameter 47. The spacing between adjacent slotted openings 50 is such that ½ to ⅔ of the area of top plate 42 between imaginary circles 52, 53 comprises the slotted opening area.

Annular diverter plate 45 has an inside diameter or inner peripheral edge 63 and an outside diameter or outer peripheral edge 64 which is shown, in FIG. 4, as pointed (60 to 90 degrees) in configuration. Diverter plate 45 is loose and retained within top and bottom plates 42, 44 by radially extending inner supports 48 and radially extending outer supports 49. Inner and outer supports 48, 49 are best shown as dotted lines in FIG. 3 and are positioned in the area between adjacent slotted openings 50 thus functioning for channels for directing the furnace atmosphere into convector plate 40 and into slotted openings 50 as described below. Outer supports 49 extend radially inwardly from a position slightly inwardly of outer peripheral edge 47 of top and bottom support plates 42, 44 to a position adjacent outer peripheral edge 64 of diverter plate 45. Similarly, inner supports 48 extend radially outwardly to a position adjacent inner peripheral edge 63 of diverter plate 45. Inner and outer supports 48, 49 equal the thickness of diverter plate 45 (1" in the preferred embodiment) and are stitch welded to top and bottom plates 42,44 along one of their radial sides and along their exposed arcuate edges. Thus supports 48, 49 provided the mechanism which assembles top and bottom plates 42, 44 and diverter plate 45 into convector plate 40 while encapsulating diverter plate 45 in a loose, free floating manner between top and bottom plates 42, 44. With convector plate 40 assembled as described, diverter plate 45 (diverter plate 45 and top and bottom plates 42, 44 have the same thickness, typically 1 inch) thermally distorts or dishes in the configuration of top and bottom plates 42, 44. Diverter plate 45 is, in a manner of speaking, going along for the ride with top and bottom plates 42, 44 because it is secured in a non-welded manner within top and bottom plates 41, 44. Thus, the assembly is flexible, if one can view an assembly of 1" plates as flexible. Slits 62 and the serrated inner edge 46 of top and bottom plates 42, 44 permit the plates to thermally distort without fatigue while inner plate 45 does not significantly resist the thermal expansion of top and bottom plates 42, 44. This arrangement results in convector plate 40 having a longer life than the prior art convector plates and allows convector plate 40 to be sold as a replacement for existing convector plates.

The dimensioning of diverter plate 45 relative to slotted opening 50 is also important to the efficient heat transfer achieved by convector plate 45. The radial length of diverter plate 45, that is the length from inner peripheral edge 63 to outer peripheral edges 64, is sized to be ½ to ⅔ the radial length of slotted opening 50.

Figure 5:
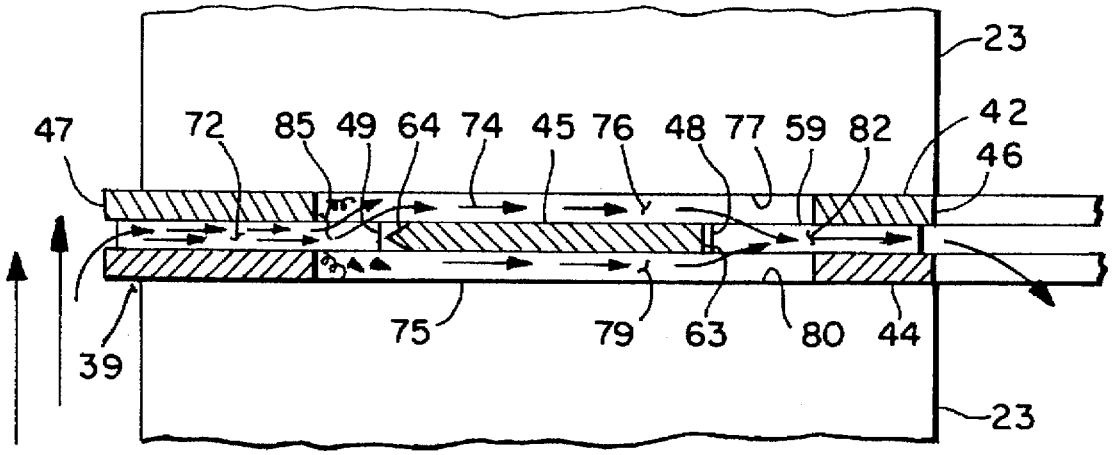
FIG. 5 is a partial, sectioned view of the convector plate of the present invention showing flow of the furnace atmosphere therethrough.

Referring now to FIG. 5, the flow of furnace atmosphere through convector plate 40 will be discussed. A portion of the furnace atmosphere by virtue of the pressure differential created by fan 30 between the outside and inside of the coils, is forced into channel 72 formed between top and bottom plates 42, 44 at their outer peripheral edge 47. Channel 72 is also formed between opposing sides of adjacent outer supports 49 so that channels 72 align with slotted openings 50. The furnace atmosphere stream (shown by arrows) travels radially inwardly in channels 72 until striking outer peripheral edge 64 of diverter plate 45 whereat the furnace stream is divided into a top stream, shown by arrows 74, and a bottom stream shown by arrows 75. Top stream 74 travels radially inwardly within convector plate 40 in a top channel 76 defined by slotted opening 50 and formed between bottom edge 77 of top coil 22 and the top surface of diverter plate 45. Similarly bottom stream 75 travels radially inwardly within convector plate 40 in a bottom channel 79 defined by slotted opening 50 and formed between top edge 80 of intermediate coil 23 and the bottom surface of diverter plate 45. After top and bottom streams 74, 75 pass inner peripheral edge 63 of diverter plate 45 the streams are reformed into one stream which passes through an inner channel 82 formed between bottom slotted opening edge 59 and inside diameter edge 46 of top and bottom plates 42, 44 before exiting to the center of coils 22, 23. The height of outer channel 72, top and bottom channel 76, 79 and inner channel 82 is equal to the thickness of plates 42, 44 and 45, i.e., 1" in the preferred embodiment. However, just prior to the furnace stream splitting into top and bottom streams 74, 75 at an annular clearance space, designated as 85, (equal to the total thickness of convector plate 40, i.e., 3"), the furnace stream expands, hits diverter plate's outer peripheral edge 64 and impinges coil edges 77, 80 at a velocity approaching that of a jet. The turbulence or eddy currents produced as a result of the impact travel in annular clearance space 85 without adversely affecting the throughput of the entering stream from outer channel 72. At the same time the furnace stream is diverted to impact the coil edge reducing the heat transfer boundary layer and establishing a good convective heat transfer co-efficient, $h_c$,. At a short distance thereafter, the boundary layer will tend to re-establish itself. Significantly, top and bottom channels 76, 79 are reducing in volume as the stream advances towards coil center 36 because of the radial nature of slotted opening side edges 55, 56. This tends to accelerate the flow and reduce the boundary layer. Because the boundary layer is attempting to reestablish itself, the net effect is believed to be a somewhat constant (or reducing) boundary layer but one significantly less than that of the prior art convector plates described above. The result then is a higher convective heat transfer co-efficient, $h_c$.

Figure 6:
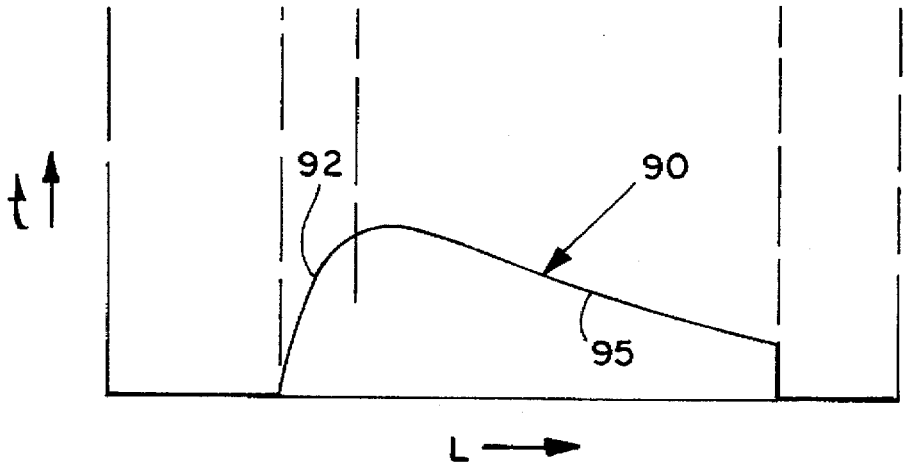
FIG. 6 is a graph showing the convective heat transfer of the present invention along the face of the coil.

The boundary layer is diagrammatically shown in FIG. 6. The heat transfer co-efficient $h_c$ is a function of the length of the channel length "L" and "t" is the boundary layer thickness. In FIG. 6, the heat transfer co-efficient or the inverse of boundary layer "t" is plotted on the y-axis and the length of top and bottom channels 76, 79 is plotted on the x-axis giving a curve 90 showing the convective heat transfer co-efficient, $h_c$, at any longitudinal position of top and bottom spaces or channels 76, 79. That portion of curve 90 which is designated 92 correlates to clearance space 85 and the O,O co-ordinate of curve 90 is the point where the furnace atmosphere stream initially impacts the coil edge after being split into top and bottom streams 74, 75. The remaining portion 95 of curve 90 is shown as slightly reducing (or fairly constant) which correlates with what is expected and has been observed in practice. While this is a significant part of the invention, those skilled in the art will appreciate that the act of splitting the furnace streams into top and bottom streams as described will result in enhanced heat transfer convection over the prior art even if the boundary layer in portion, 95 of curve 90 increased. Accordingly, any slotted opening could be used and improved results will occur. However, by forming the specifically described slotted opening with radial side edges 55, 56, the design is optimized. Again, the furnace gas stream is not a jet but tends to approach a jet in total clearance space 85. Heat transfer is principally achieved by the high volume flows inherent in the batch coil design which have been made more efficient by convector plate 40 of the present invention. While the coil edge is not completely exposed to the furnace atmosphere in convector plate 40, a sufficient area is exposed to permit the covered area to effectively transfer heat by conduction from or to the exposed areas provided by slotted openings 50. Importantly, convective heat transfer is established with the middle third of the coil face which, as noted above, is the critical area to establish heat transfer with.

The invention has been described with reference to a preferred embodiment. Obviously, modifications and alterations will become apparent to those skilled in the art upon reading and understanding the detailed description set forth above. For example, the invention has been described with reference to the furnace atmosphere flowing from the outside of the coils towards the center. The design can be modified by using polygonal configured slotted openings if the flow were from the center of the coils towards the outside edge. It is intended to include all such modifications and alterations insofar as they come within the scope of the present invention.

Having thus defined the invention it is claimed:

1. A batch coil annealing furnace convector plate comprising:

a) a top annular plate and a bottom, similarly shaped annular plate, each having slotted openings formed therethrough, said openings extending radially outwardly from an imaginary circle, support means connecting said top and bottom plates together in a spaced apart relationship; and b) an annular diverter plate in between said top and bottom plates and not secured to said top and bottom plates, said diverter plate having a radial length less than the length of said radially-extending openings and an inside diameter greater than that of said imaginary circle.

2. A batch coil annealing furnace convector plate comprising:

a) a top annular plate and a bottom, similarly shaped annular plate, each having slotted openings formed therethrough, said openings extending radially outwardly from an imaginary circle;

b) an annular diverter plate in between said top and bottom plates, said plate having a radial length less than the length of said radially-extending openings and an inside diameter greater than that of said imaginary circle, and c) said top and bottom plate's openings extend radially outwardly to a position lying on a second imaginary circle, and said diverter plate has an outside diameter less than that of said second imaginary circle.

3. The convector plate of claim 2 wherein said top and bottom plate's openings are polygonal in configuration.

4. The convector plate of claim 2 wherein said top and bottom plate's openings are defined by side edges radially extending from the center of said top and bottom plates.

5. The convector plate of claim 4 wherein said top and bottom plate's slotted openings overlie and are in registry with one another.

6. The convector plate of claim 5 wherein the radial length of said top and bottom plate's openings is ½ to ⅔ the radial length of said top and bottom plates.

7. The convector plate of claim 6 wherein the radial length of said diverter plate is one half to three-fourths the radial length of said openings in said top and bottom plates.

8. The convector plate of claim 7 further including each top and bottom plate having a slit extending therethrough from the outer periphery of each plate to at least one of the slotted openings in said top plate and said bottom plate whereby said top and bottom plates resist thermal failure.

9. The convector plate of 8 wherein said top plate is secured to said bottom plate by i) a plurality of first supports extending adjacent to the outer peripheral edge of said top and bottom plates radially inwardly to a position adjacent the outer peripheral edge of said diverter plate and ii) a plurality of second supports extending adjacent to the inner peripheral edge of said top and bottom plated radially outwardly to a position adjacent the inner peripheral edge of said diverter plate whereby said diverter plate in a loose manner between said first and second supports and between said top and bottom plates.

10. The convector plate of claim 9 wherein said inner and outer supports are welded to said top and bottom plates at positions in between said slotted openings to form channels for ingress and egress of furnace atmosphere to and from said slotted openings within said convector plate.

11. The convector plate of claim 1 wherein said top and bottom plate's openings overlie and are in registry with one another.

12. The convector plate of claim 2 further including each top and bottom plate having a slit extending therethrough from the outer periphery of said top and bottom plates to every other slotted opening in said top and bottom plates whereby said top and bottom plates resist thermal failure.

13. The convector plate of claim 2 wherein said top plate is secured to said bottom plate by i) a plurality of first supports extending adjacent to the outer peripheral edge of said top and bottom plates radially inwardly to a position adjacent the outer peripheral edge of said diverter plate and ii) a plurality of second supports extending adjacent to the inner peripheral edge of said top and bottom plated radially outwardly to a position adjacent the inner peripheral edge of said diverter plate whereby said diverter plate in a loose manner between said first and second supports and between said top and bottom plates.

14. The convector plate of claim 13 wherein said inner and outer supports are welded to said top and bottom plates at positions in between said slotted openings to form channels for ingress and egress of furnace atmosphere to and from said slotted openings within said convector plate.

15. In a batch coil annealing furnace having a base upon which a plurality of metal strip coils are stacked one on top the other, a closed end cylindrical cover releasably sealed to said base and enclosing said coils, burner means associated with said cover for heating same and in turn heating furnace atmosphere within said cover and a fan in said base for circulating atmosphere within said cover under pressure from the outside of said coils to the inside thereof by flowing said furnace atmosphere i) over the top coil into the inside of said coils and ii) between the edges of adjacent coils separated from one another by a convector plate, the improvement comprising:

said convector plate having a) a top annular plate and a bottom, similarly shaped annular plate, support means securing said top and bottom plates together in a spaced apart relationship; each top and bottom plate having slotted openings formed therein, said openings extending outwardly from a first imaginary circle; and b) an annular diverter plate in between said top and bottom plates and movable therebetween, said plate having a radial length less than the length of said slotted openings and an inside diameter greater than that of said first imaginary circle whereby said atmosphere is forced into heat transfer contact with the edges of the strip in each coil by passing through said openings in the space thereof between the coil's edge and said diverter plate before reaching the center of said coil.

16. The improvement of claim 15 wherein said top and bottom plate's openings are defined by side edges radially extending from the center of said top and bottom plates.

17. The improvement of claim 16 wherein said top and bottom plate's slotted openings overlie and are in registry with one another.

18. The improvement of claim 17 wherein the radial length of said top and bottom plate's openings is ½ to ⅔ the radial length of said top and bottom plates.

19. The improvement of claim 18 wherein the radial length of said diverter plate is one half to three-fourths the radial length of said openings in said top and bottom plates.

20. In a batch coil annealing furnace having a base upon which a plurality of metal strip coils are stacked one on top the other, a closed end cylindrical cover releasably sealed to said base and enclosing said coils, burner means associated with said cover for heating same and in turn heating furnace atmosphere within said cover and a fan in said base for circulating atmosphere within said cover under pressure from the outside of said coils to the inside thereof by flowing said furnace atmosphere i) over the top coil into the inside of said coils and ii) between the edges of adjacent coils separated from one another by a convector plate, the improvement comprising:

said convector plate having a) a top annular plate and a bottom, similarly shaped annular plate, each top and bottom plate having slotted openings formed therein which overlie and are in registry with one another, said openings defined by side edges radially extending from the center of said top and bottom plates outwardly from a first imaginary circle and stopping at a second imaginary circle, the radial length of said top and bottom plate's openings being ½ to ⅔ the radial length of said top and bottom plates;

b) an annular diverter plate in between said top and bottom plates, said plate having a radial length one half to three fourths the radial length of said slotted openings in said top and bottom plates and an inside diameter greater than that of said first imaginary circle whereby said atmosphere is forced into heat transfer contact with the edges of the strip in each coil by passing through said openings in the space thereof between the coil's edge and said diverter plate before reaching the center of said coil; and c) each top and bottom plate having a slit extending therethrough from the outer periphery of each plate to at least one of the slotted openings in said top plate and said bottom plate whereby said top and bottom plates resist thermal failure.

21. The improvement of claim 20 wherein said top plate is secured to said bottom plate by i) a plurality of first supports extending adjacent to the outer peripheral edge of said top and bottom plates radially inwardly to a position adjacent the outer peripheral edge of said diverter plate and ii) a plurality of second supports extending adjacent to the inner peripheral edge of said top and bottom plated radially outwardly to a position adjacent the inner peripheral edge of said diverter plate whereby said diverter plate in a loose manner between said first and second supports and between said top and bottom plates.

22. The improvement of claim 21 wherein said inner and outer supports are welded to said top and bottom plates at positions in between said slotted openings to form channels for ingress and egress of furnace atmosphere to and from said slotted openings within said convector plate.

23. In a batch coil annealing furnace having a base upon which a plurality of metal strip coils are stacked one on top the other, a closed end cylindrical cover releasably sealed to said base and enclosing said coils, burner means associated with said cover for heating same and in turn heating furnace atmosphere within said cover and a fan in said base for circulating atmosphere within said cover under pressure from the outside of said coils to the inside thereof by flowing said furnace atmosphere i) over the top coil into the inside of said coils and ii) between the edges of adjacent coils separated from one another by a convector plate, the improvement comprising:

said convector plate having a) a top annular plate and a bottom, similarly shaped annular plate, each top and bottom plate having slotted openings formed therein, said openings extending outwardly from a first imaginary circle and stopping at a second imaginary circle;

b) an annular diverter plate in between said top and bottom plates, said plate having a radial length less than the length of said slotted openings and an inside diameter greater than that of said first imaginary circle whereby said atmosphere is forced into heat transfer contact with the edges of the strip in each coil by passing through said openings in the space thereof between the coil's edge and said diverter plate before reaching the center of said coil; and c) each top and bottom plate having a slit extending therethrough from the outer periphery of said top and bottom plates to every other slotted opening in said top and bottom plates whereby said top and bottom plates resist thermal failure.

24. The improvement of claim 23 wherein said top plate is secured to said bottom plate by i) a plurality of first supports extending adjacent to the outer peripheral edge of said top and bottom plates radially inwardly to a position adjacent the outer peripheral edge of said divergent plate and ii) a plurality of second supports extending adjacent to the inner peripheral edge of said top and bottom plated radially outwardly to a position adjacent the inner peripheral edge of said diverter plate whereby said diverter plate is held in a loose manner between said first and second supports and between said top and bottom plates.

25. The improvement of claim 24 wherein said inner and outer supports are welded to said top and bottom plates at positions in between said slotted openings to form channels for ingress and egress of furnace atmosphere to and from said slotted openings within said convector plate.

26. A process for convectively heating and cooling metal strip wound into coils and placed in a batch coil annealing furnace so that the coils are vertically stacked on a base one on top of the other while separated from each other by a convector plate therebetween and a fan causes hot or cooled furnace atmosphere to circulate in a closed loop from the base, around the outside of the coils to the top coil and into the coil centers downward to the base while a portion of the atmosphere travels radially between the coils through said convector plate, said process comprising the steps of:

a) providing a solid annular diverter plate between two larger top and bottom annular plates, each larger plate having slotted openings overlying said diverter plate and in registry with one another;

b) directing a portion of the furnace atmosphere into the space between said top and bottom plates at the peripheral edge thereof as a gas stream;

c) splitting said stream at the outer peripheral edge of said diverter plate into a top stream and a bottom stream;

d) directing said top and bottom steams into heat transfer contact with the coil edge overlying said slotted openings while said streams travel radially inwardly in the slotted opening space between said convector plate and said coil's edge, and e) combining said top and bottom streams at the inner peripheral edge of said diverter plate in the space between said top and bottom plates before exhausting same to the center of said coil.

27. The process of claim 26 further including the step of maintaining the heat boundary layer at the coil edge generally constant by decreasing the slotted opening area defining the space between said coil edge and said diverter plate as said top and bottom streams travel radially inwardly to the center of said coil.

28. The process of claim 27 further including the step of providing said slotted openings in said top and bottom plates as extending from a first imaginary circle having a diameter smaller than the inside diameter of said diverter plate to a second imaginary circle having a diameter greater than the outside diameter of said diverter plate but less than the outside diameter of said top and bottom plates with each opening defined by two side edges extending radially to the center of said top and bottom plates and spaced from one another at a fixed arcuate distance.

29. The process of claim 26 wherein the closed circulation loop of said furnace atmosphere progresses from said base through the center of said coils to the top coil and down to said base around the outside of said coils while a portion of said atmosphere travels through said diverter plates from the inside of said coils to the outside thereof and the progression of said furnace atmosphere through said convector plate is radially outwardly.

* * * * *